United States Patent [19]

Comastri et al.

[11] 4,072,955

[45] Feb. 7, 1978

[54] MULTIBAND ANTENNA FOR WINDOW PANES

[75] Inventors: Mauro Comastri, Monza; Giorgio Ciarniello, Vasto (Chieti), both of Italy

[73] Assignee: Societa Italiana Vetro Siv S.p.A., Vasto (Chieti), Italy

[21] Appl. No.: 708,762

[22] Filed: July 26, 1976

[30] Foreign Application Priority Data

July 24, 1975 Italy ..... 50647/75

[51] Int. Cl.[2] ..... H01Q 1/32

[52] U.S. Cl. ..... 343/713

[58] Field of Search ..... 343/711, 712, 713

[56] References Cited

U.S. PATENT DOCUMENTS 3,680,132 7/1972 Tolliver ..... 343/713

4,003,056 1/1977 Davis ..... 343/713

FOREIGN PATENT DOCUMENTS 2,023,823 11/1971 Germany ..... 343/713

*Primary Examiner*—Eli Lieberman

*Attorney, Agent, or Firm*—Browdy and Neimark

[57] ABSTRACT

A multiband antenna as applied to a window pane, such as a windshield, includes a terminal which is to constitute a connection to a receiver. One or two conductors are attached to the terminal and extend vertically upward toward the top rim of the pane, are bent or branched so as to extend substantially parallel to and closely spaced from the top rim, side rims and bottom rim of the pane. End portions of the two conductors or branched single conductor are looped back and extend parallel to the legs which run parallel to the rims.

17 Claims, 10 Drawing Figures

MULTIBAND ANTENNA FOR WINDOW PANES

BACKGROUND OF THE INVENTION

The present invention relates to a radio-receiving multiband antenna supported on window panes, particularly for a windshield of motor vehicles. The term "window pane" is intended to mean in this connection a pane of glass or of plastic material and the antenna may consist of electric conductors deposited by the silk screen process on the pane, preferably on that face of the pane which, when fitted into the car, is the internal one; or else, if in lieu of tempered glass, two bonded together glass panes are used, applied to that face of the pane, which is in contact with the other face. Obviously, in lieu of conductors made by the silk screen process, also a conducting metal wire may be used.

Obviously, such antenna may be applied to any window of a motor vehicle, although the windshield is the most suitable place.

The antenna according to the present invention has been designed to receive radio-frequency signals in their various bands of transmissions, such as long waves, medium waves, short waves, metric or frequency modulation waves (FM) and VHF, decimetric waves and UHF and all the waves for sound and/or television information, included the frequencies reserved for radio amateurs.

The antenna incorporated in the pane, particularly in the windshield, is preferred to the conventional, freely supported motorcar antennas, because they are subjected to various drawbacks, such as:

a) considerable vibrations during driving which render the signal fluctuating, particularly when receiving distant stations and the receiver operates in threshold conditions;

b) marked instability in their characteristics, such as increase of their resistance and consequent increase in their losses, changes in the capacity of the antenna, due to its aging, to the possibility of water penetration in the cylindric bottom element, which causes corrosion and oxidation of the tubular elements in a polluting or brackish atmosphere;

c) in the case of fishpole antennas, the fact that they strongly project beyond the motorcar contours, which leads often to their breaking, for instance when entering a garage, an underpass, etc., or damaging persons and goods if they are badly installed;

d) furthermore the fishpole antenna is also subject to be willfully broken by vandals.

For all these reasons windshield antennas have been developed.

It is well known that the major part of radio-receiving sets for motor vehicles is provided with a single aerial socket, differently from the domestic receivers which have an input for the medium waves and one for the metric waves (FM), therefore a problem which must be faced in the aerials embedded in motorcar windshields is that of obtaining good reception of the medium waves as well as of the metric waves in a single antenna socket of the radio-receiving set.

In order to obtain a good reception, the ideal would be that of having an antenna of a length equal to a well defined fraction of the wave length to be received, such as $\lambda/2$ or $\lambda/4$ according to whether the antenna is of a symmetrical or assymetrical type. The standard sizes of motor vehicle windshields render, at least for the medium wave range, antennas of such length impossible.

SUMMARY OF THE INVENTION

The invention solves the above mentioned problem by providing an antenna wherein the geometry of its conductors is such as to form two parts, the first one constituting the active element in the reception of medium waves and the second part forming the active element for the reception of metric waves, but wherein that part of the antenna, which is not involved during the reception of one band, does not form a parasitic element during the reception of this band, but even contributes positively toward the reception of the whole signal. For this reason the whole antenna, in lieu of acting like two distinct units, acts as a real multiband antenna.

The invention will be better understood from the following description, made with reference to the attached drawing, wherein.

DETAILED DESCRIPTION OF THE PREFERRED EMBODIMENT

Figure 1A:
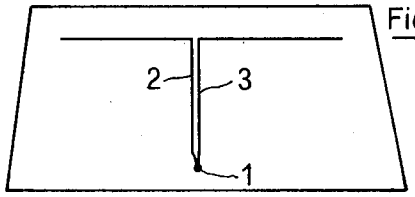
PRIOR ART Fig. 1A
FIGS. 1A and 1B represents respectively two conventional, two-conductor T-type antennae applied to a windshield.

All embodiments are shown as applied to a windshield.

FIGS. 1A, 2A, 3A, 4A and 5A show two-conductor versions; FIGS. 1B, 2B, 3B, 4B, and 5B show a single conductor version of the respective embodiment. In all figures, the same elements have been indicated with the same reference numerals.

Figure 1B:
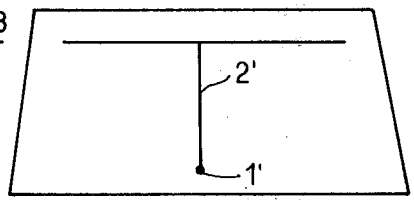
PRIOR ART Fig. 1B

The known antennas of FIGS. 1A and 1B comprise a vertical leg 2' (FIG. 1B) or two parallel, spaced apart vertical legs 2 and 3 (FIG. 1A), extending upwards from a terminal 1' or 1 respectively, located a few centimeters above the lower windshield rim. These vertical legs form the antenna for the reception of metric waves. In FIG. 1B, the known antenna forms a T with its horizontal portion running at a distance of preferably 7 cm from the upper windshield rim. In FIG. 1A, each leg, at a given distance, preferably 7 cm from the upper windshield rim, is bent to the left and respectively to the right to form a horizontal leg for the reception of the metric waves.

According to the invention it has now been found that if each free end of the horizontal leg is bent downward to form a second leg 4 or 4' respectively, running parallel to the left and to the right rim respectively of the windshield, the reception of the medium waves is considerably improved. This leg may be further extended by adding to it a further leg 5 or 5' respectively, (FIGS. 3A, 3B) or by doubling the two last legs or all three legs as indicated at 6, 6' or 7, 7' in FIGS. 4A, 4B and FIGS. 5A and 5B.

In fact, with such antenna configurations a good reception of the medium waves has been attained, since they yield an antenna capacity nearing 70/100 pF with a resistance loss of the magnitude of some hundred kohm, while for the metric waves a prevalently resistive antenna impedance of approximately 150 ohm has been found (phase angle not over ± 30°).

In all these antenna configurations, as precedently mentioned, it has been found that the optimum distance of the antenna conductors from the windshield rim is normally 7 cm and, when the windshield dimensions permit it without interfering with the area of visibility established for the various windshield types, it has been found that this distance may advantageously be increased to approximately 9–10 cm. In the configurations illustrated in FIGS. 4A, 4B the legs 5, 5' are loped back at their free end to extend into a leg 6, 6' respectively running parallel to legs 5, 4 and 5', 4' respectively. In FIGS. 5A, 5B this leg as indicated by 7 or 7' respectively is further extended to run parallel with the horizontal leg of conductor 2, 3 or 2', 3' respectively. In the antennas shown in FIGS. 4A, 4B, 5A, 5B the space between parallel conductors may range between 1.2 and 0.2 cm, preferably 0.4 cm.

The length of the antenna conductors may vary according to whether the antenna is made from wire having normally a diameter of 0.1 – 0.2 mm, or by the silk screen process. In fact, when using wire the antenna is sandwiched between the two panes which form the windshield, while an antenna made by the silk screen process may be applied either to the interface of the panes or to the internal face of the windshield. Therefore, since the speed of propagation of the electromagnetic waves is different accordng to where it is intended to receive the signal, also these parameters must be taken into account.

Figure 2A:
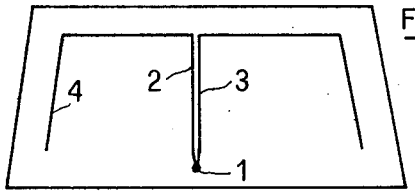
FIGS. 2A and 2B show two versions of a first embodiment of the antenna according to the invention.
Figure 2B:
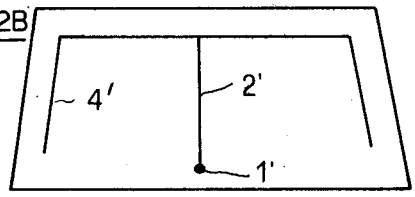

So for instance, with an antenna structure of the type illustrated in FIGS. 2A, 2B on a windshield sized approximately 60 × 130 cm there has been found a capacity of over 50 pF, a resistance loss of approximately 500 kohm and an antenna impedance variable between 100 and 200 ohm in the frequency range between 88 and 108 MHz.

Figure 3A:
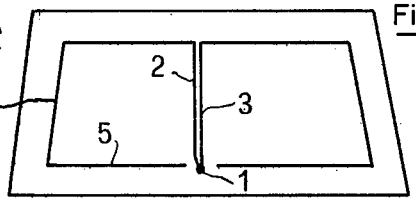
FIGS. 3A and 3B show a second embodiment of an antenna according to the invention, in two versions.
Figure 3B:
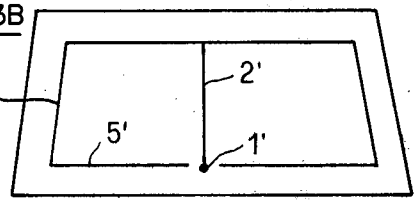
Figure 4A:
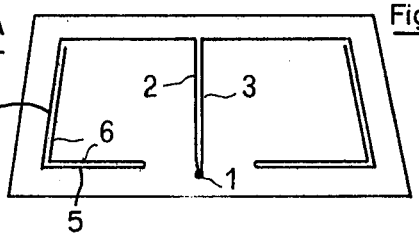
FIGS. 4A and 4B show a third embodiment of the antenna according to the invention, in two versions.
Figure 4B:
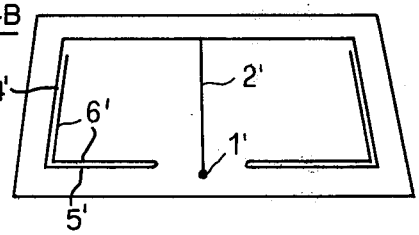
Figure 5A:
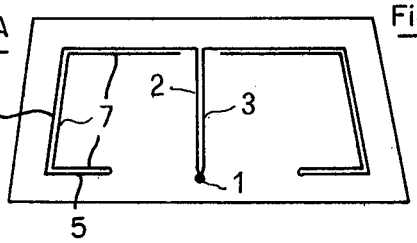
FIGS. 5A and 5B show a fourth embodiment of the antenna according to the invention, in two versions.
Figure 5B:
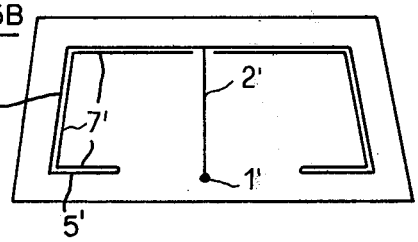

On a windshield of the same dimension, when extending the antenna conductors in the manner shown in FIGS. 3a, 3b, with the free end of leg 5 or 5' ending at a few centimeters, for instance 2 cm, from the antenna terminal 1, there is an increase of capacity up to approximately 70 pF, while the other characteristics remain practically the same.

Where the size of the windshield or of some other antenna support is smaller than those above indicated, the configurations shown in FIGS. 4A and 5A may be applied, which insure a capacity in the range between 60 and 70 pF, resistance losses of over 400 Kohm and an antenna impedance ranging around 150 ohm, with a phase angle of ± 30°.

The following comparative table shows the increase in the voltage values as measured on the receiver terminals for antennas having a conformation like that illustrated in the FIGS. 2A, 2B; FIGS. 3A, 3B; FIGS. 5A, 5B respectively, as compared with those yielded by the conventional antenna shown in FIGS. 1A, 1B taken as a unit. These measurements were made on antennas applied to a windshield sized 60 × 130 cm, for the reception of medium waves and metric waves.

This table shows therefore clearly that the test data confirm the improvements over the known art obtained by following the concepts of the present invention.

It is clear that the idea of the invention is not limited to the embodiments shown and described, but includes any possible variance thereof.

TABLE

| Antenna of | FIGS. 1a, 1b | FIGS. 2a, 1b | FIGS. 3a, 1b | FIGS. 5a, 5b |
|---|---|---|---|---|
| M W | 1 | 1,3 | 1,6 | 1,8 |
| F M | 1 | 1,2 | 1,25 | 1,35 |

We claim:

1. A multiband antenna as applied to a window pane, particularly a windshield, for reception of radio signals for a radio receiver having a single antenna input, the antenna comprising: a terminal for connection of the antenna to the receiver; and two conductors electrically connected to said terminal and extending in a generally vertical direction substantially parallel to one another up to a distance a few centimeters from a first rim of said pane, each one of said conductors respectively bending thereafter substantially 90° in opposite directions, so as to define a pair of first legs which extend parallel to said first rim, each one of said conductors being thereafter substantially a second 90° in the vicinity of respective second and third rims of said pane so as to define a pair of second legs, each one of said conductors being respective third and fourth legs running respectively substantially parallel to at least said pair of second legs.

2. A multiband antenna according to claim 1, wherein said third and fourth legs respectively parallel long at least a portion of respective ones of said first pair of legs.

3. A multiband antenna, according to claim 2, wherein each one of said conductors is bent substantially a third 90° in the vicinity of a fourth rim of said pane so as to define a pair of additional legs, said third and said fourth legs running respectively parallel to said pair of additional legs.

4. A multiband antenna, according to claim 1, wherein each one of said conductors is bent substantially a third 90° in the vicinity of a fourth rim of said pane so as to define a pair of additional legs, said third and said fourth legs running respectively parallel to said pair of additional legs.

5. A multiband antenna according to claim 1, wherein the distance between each of said third and said fourth legs and a respective one of portions of said conductors defining said pair of legs is between substantially 1.2 and substantially 0.2 cm.

6. A multiband antenna according to claim 5, wherein said distance is between substantially 1.2 and substantially 0.3 cm.

7. A multiband antenna according to claim 5, wherein said distance is substantially 0.4 cm.

8. A multiband antenna according to claim 1, wherein spacing between respective said rims of said pane and the respective legs is between substantially 7 and substantially 10 cm.

9. A multiband antenna according to claim 1, wherein said first rim of said pane is its upper rim and said two conductors extend upward from said terminal.

10. A multiband antenna applied to a window pane, particularly a windshield, for the reception of radio signals for a radio receiver having a single antenna input, the antenna comprising: terminal for connection of the antenna with the receiver input, said terminal being located at a few centimeters from a first rim of said pane; an antenna conductor in electrical contact with said terminal and directed along a vertical path to a distance of a few centimeters from a second rim of said pane and branching off into two oppositely directed legs, which follow along said second rim, are turned respectively substantially 90°, and respectively follow along respective third and fourth rims of said pane and wherein free ends of said legs are looped back to form respective additional legs running parallel to at least portions of said oppositely directed legs.

11. A multiband antenna according to claim 10, wherein each of said respectively additional legs run parallel to respective portions of said oppositely directed legs which follow along said respective third and fourth rims and along at least portions of said oppositely directed legs which follow along said rim.

12. A multiband antenna according to claim 11, wherein each of said additional legs run parallel to respective portions of said oppositely directed legs which follow along said first rim.

13. A multiband antenna according to claim 10, wherein each of said additional legs run parallel to respective portions of said oppositely directed legs which follow along said first rim.

14. A multiband antenna according to claim 10, wherein the distance between said oppositely directed legs and respective ones of said additional legs is between substantially 1.2 and substantially 0.2 cm.

15. A multiband antenna according to claim 14, wherein said distance ranges between substantially 1.2 and substantially 0.3 cm.

16. A multiband antenna according to claim 14, wherein said distance is substantially 0.4 cm.

17. A multiband antenna according to claim 10, wherein spacing between respective rims of said pane and respective portions of said oppositely directed legs is between substantially 7 and substantially 10 cm.

* * * * *

UNITED STATES PATENT AND TRADEMARK OFFICE

CERTIFICATE OF CORRECTION

PATENT NO. : 4,072,955

DATED : February 7, 1978

INVENTOR(S) : COMASTRI et al.

It is certified that error appears in the above-identified patent and that said Letters Patent are hereby corrected as shown below:

Claim 1, line 12, "being" should read --bending--

Claim 1, line 15, after "being" insert --respectively looped back to form--

Claim 2, line 2, after "legs" insert --run--; change "long" to --along--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*